US005706755A

United States Patent [19]

O'Brien

[11] Patent Number: 5,706,755

[45] Date of Patent: Jan. 13, 1998

[54] ACCESS AND EVACUATION SYSTEM FOR AN OFFSHORE PLATFORM

[75] Inventor: Daniel P. O'Brien, St. John's, Canada

[73] Assignee: Seascape Systems Limited, St. Johns, Canada

[21] Appl. No.: 764,595

[22] Filed: Dec. 11, 1996

Related U.S. Application Data

[63] Continuation of Ser. No. 524,461, Sep. 7, 1995, abandoned.

[51] Int. Cl.[6] ..... B63B 23/04

[52] U.S. Cl. ..... 114/365; 114/366; 114/373

[58] Field of Search ..... 114/44, 365, 367, 114/373, 377, 378, 375, 259, 366; 414/137.7; 472/44, 45, 46; 105/149, 149.1, 149.2

[56] References Cited

U.S. PATENT DOCUMENTS

| | | | |
|---|---|---|---|
| 426,449 | 4/1890 | Hosford . | |
| 582,069 | 5/1897 | Leslie . | |
| 2,091,327 | 8/1937 | McParland . | |
| 3,834,338 | 9/1974 | Renouf | 114/43.5 |
| 4,522,144 | 6/1985 | Klem . | |
| 4,662,300 | 5/1987 | McCallum et al. | 114/259 |
| 4,781,144 | 11/1988 | O'Brien | 114/373 |
| 5,341,761 | 8/1994 | O'Brien et al. . | |

FOREIGN PATENT DOCUMENTS

| | | |
|---|---|---|
| 1 208 082 | 7/1986 | Canada . |
| 33 14 774 | 10/1984 | Germany . |
| 33 29 159 | 2/1985 | Germany . |
| 120140 | 10/1918 | United Kingdom . |
| 2 108 054 | 5/1983 | United Kingdom . |
| 2 123 353 | 2/1984 | United Kingdom . |
| 2 135 272 | 8/1984 | United Kingdom . |

*Primary Examiner*—Sherman Basinger

*Attorney, Agent, or Firm*—Gary M. Nath; Nath & Associates

[57] ABSTRACT

There is provided a new and useful access and evacuation sytem for an offshore platform, the system comprising a rotating arm for mounting on the support structure of an offshore platform, the arm selectively moveable between an upper position in which an outer end of the arm is adjacent the platform, and a lower position in which the outer end of the arm is below water and remote from the platform; a pick-up adjacent the outer end of the arm for capturing and suspending a boat; a winch for selectively raising and lowering the arm; a boat; a suspension on the boat for mating with the pick-up; and shock absorbers on the suspension whereby to minimize shock to the boat when boat is being captured by the pick-up. In a further aspect of the invention there is provided a survival craft having mounted thereon a suspension for lifting and lowering the craft, the suspension comprising at least one suspension support member secured to the boat, a transverse member carried on the at least one suspension support, and a shock absorber on at least one suspension support member.

23 Claims, 3 Drawing Sheets

ACCESS AND EVACUATION SYSTEM FOR AN OFFSHORE PLATFORM

This application is a Continuation of U.S. patent application Ser. No. 08/524,461, filed Sep. 7, 1995, and now abandoned, the contents of which are incorporated herein in their entirely.

FIELD OF THE INVENTION

This application relates to access and evacuation systems for offshore work platforms, such as drilling and production platforms in the offshore petroleum industry.

BACKGROUND OF THE INVENTION

Offshore platforms for various uses, including ocean research, are in widespread use throughout the world. The majority of these platforms are found in the offshore petroleum industry in exploration and production functions.

The offshore drilling industry and technology associated with it have developed rapidly in the last 30 years. The drilling rigs in use today have evolved into sophisticated structures, designed and built to withstand the severest of environmental conditions and to operate in very deep waters. Advanced computer technology has contributed substantially to bring platform development to its present position. Computers are integral, for example, to the collection and evaluation of geological and seismic data, to the operation of dynamically positioned platforms, and to methods of well control.

Furthermore, such modem technology has led to the development of platforms serving various functions and which are in the normal course of operation unmanned. Characteristically, these unmanned platforms require to be maintained on a regular basis and to therefore be accessible to maintenance crews. Currently and for some years access to these platforms is by helicopter. There are very significant disadvantages in the use of helicopters to access platforms. The platform structure itself requires to be provided with a helicopter landing pad. This is a very significant expense and, as well, an engineering disadvantage on many small platforms. Finally, helicopter usage is the single most dangerous aspect of the offshore industry.

As is well documented, evacuation systems used in emergency evacuation of offshore platforms have not performed well with resulting high loss of life. There has therefore been an ongoing search for more reliable evacuation systems.

At the same time, the increasing use of unmanned platforms, and the problems discussed above incident to those platforms, have led to a need for better access systems to enable ready access to such platforms.

Against this background the present invention combines aspects of known evacuation systems with a unique access system to address a number of the problems discussed above. A unique marine access craft is provided for use in the system.

PRIOR ART

A very large number of systems for evacuation of ocean-going vessels have been devised over a long period of years. These generally have been concerned with the specific manner of launch of lifeboats from ships and, more recently, from platforms.

U.S. Pat. No. 426,449, issued 29 Apr. 1890 to Hosford, illustrates a traditional boat and launch mechanism with a two-hook hanging float-off bar. The lifeboat has corresponding hooks or U-form bolts. Such systems have been rejected for modem platform evacuation, because of the uncertainty in the disengagement of the U.S. Pat. No. 582,069, issued 4 May 1987 to Leslie, illustrates an early version of a system utilizing rotating davits which carry a cradle to support a lifeboat. The cradle is wheeled and moves on tracks on the davits to maintain trim as the davits are lowered. The davits simply submerge to allow the boat to float off of the cradle.

U.K. Patent 120,140, issued 31 Oct. 1918 to Jones, illustrates an early version of a hook and eye system in which a pair of eyes supported on bails on a boat are intended to float off of a corresponding pair of hooks suspended from davits. The elongated davits rotate from a vertical to a horizontal position during a launch.

U.S. Pat. No. 2,091,327, issued 31 Aug. 1937 to McPartland, illustrates a somewhat later version of an escape system in which a pair of rotating davits move down to water level to release a lifeboat. The davits form a part of a rail system on a ship by which the boats are transferred to the davits. The boat floats from upturned ends of the davit rail when the davit is lowered. A locking device is provided for maintaining the davits in position when not in use.

U.S. Pat. No. 4,522,144, issued 11 Jun. 1985 to Klem, illustrates a free-fail system, the free-fall concept having become the subject of a considerable amount of research in recent years. The boat is held rigidly when not in use, since the angle of approach to the water when the boat is released is critical.

Canadian Patent 1,208,082, issued to the present inventor, O'Brien, 22 Jul. 1986, illustrates a system having general similarities to the present. It is of note that that system utilized a cradle to support the lifeboat.

U.K. published application No. 2,108,054, Auberty et al, published 11 May 1983, illustrates a semi-submersible lifeboat which is stored in a ship below the water line. The lifeboat is stored on a cradle, the cradle being ejected when a hatch is blown to allow a launch. The boat floats from or is forcibly ejected from the cradle and gradually reaches the surface as it moves away from the ship. The boat is provided with pins which rest in slots in the edge of the cradle.

U.K. published application No. 2,123,353, Bengtsson, published 1 Feb. 1984, illustrates another version of a free-fall lifeboat. The boat is hooked over a capsule on the end of a boom, and when the boom is lowered to a certain level, the capsule simply slides off the boom to free-fall to the water surface.

U.K. published application No. 2,135,272A, Garrad et al, published 30 Aug. 1984, provides a rotating davit which carries a double cradle from which lifeboats are launched. The application is written in very general terms and does not show how the unit might be usable with a single lifeboat as opposed to a pair.

Finally, the present inventor's U.S. Pat. No. 5,341,761, issued 30 Aug. 1994, describes an evacuation system for safely launching survival craft from drilling platforms in all weather conditions.

SUMMARY OF THE INVENTION

Applicant has now developed a system in which the same apparatus may be utilized for both evacuation and access functions. An important feature of the invention is the provision of a shock absorbing suspension system for a survival craft which enables the craft to be lifted out of the water and carried up to the platform with minimal shock to the boat and to its occupants.

Thus, the invention provides an access and evacuation system for an offshore platform, the system comprising a rotating arm for mounting on the support structure of an offshore platform, the arm selectively moveable between an upper position in which an outer end of the arm is adjacent the platform, and a lower position in which the outer end of the arm is below water and remote from the platform; pick-up means adjacent the outer end of the arm for capturing and suspending a boat; a winch for selectively raising and lowering the arm; a boat; suspension means on the boat for mating with the pick-up means; and shock absorbing means on the suspension means whereby to minimize shock to the boat when boat is being captured by the pick-up means. In a further aspect of the invention there is provided a survival craft having mounted thereon suspension means for lifting and lowering the craft, the suspension means comprising at least one suspension support member secured to the boat, a transverse member carried on the at least one suspension support, and a shock absorber on at least one the suspension support member.

BRIEF DESCRIPTION OF THE DRAWINGS

In drawings which illustrate embodiments of the invention.

Figure 2:
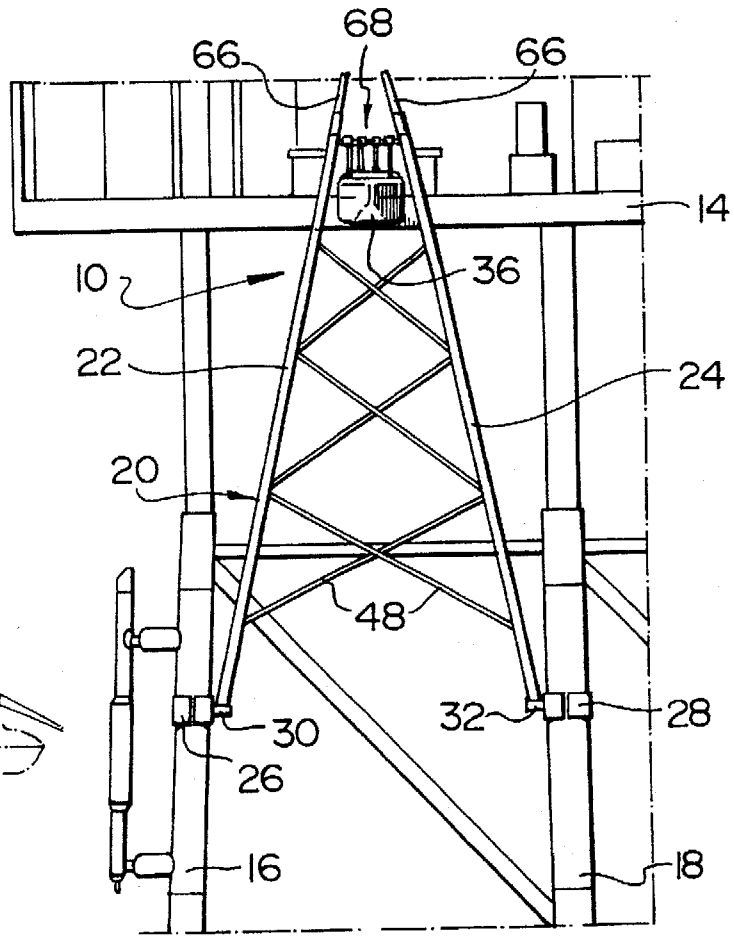
FIG. 2 is a front elevation of the system of FIG. 1.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

The access and evacuation system 10 is shown mounted on an offshore work platform 12.

The platform 12 comprises work levels including deck 14 which are supported in part by risers 16 and 18. The arm 20 comprising elongate members 22 and 24 is rotatably secured to risers 16 and 18 by clamps 26 and 28 respectively.

A marine access craft (boat) 36 is illustrated suspended at the end of arm 20 in a manner to be discussed below.

Clamps 26 and 28 may be of a type known in the industry. The actual mechanisms 30 and 32 of rotation are mounted on clamps 26 and 28 respectively. The clamps are located preferably at or about the high astronomical tide level (HAT).

The system comprises means 38 for controlling the raising and lowering of rotatable arm 20. In the preferred case the means 38 comprises a winch 40 and cable 42. Cable 42 is attached at bracket 46 to rotatable arm 20. Winch 40 may be remote controlled.

The winch per se does not form a part of the present invention. A suitable winch including an appropriate braking device may be used. In the preferred embodiment the winch is operable by remote control from the water surface, so that raising and lowering of arm 20 can be controlled from a boat on the water.

In the preferred embodiment, as noted, the rotatable arm 20 comprises elongate members 22 and 24 which are secured together and suitably reinforced by a cross-bracing 48. In the preferred case elongate members 22 and 24 are tubular.

The elongate members 22 and 24 may include integral support members 50 and 52 each of which carries thereon pick-up means preferably in the form of open claw structures 54. Each said claw structure includes a base member 56 and open seat 58 defined by upper side 62 and lower side 64.

Figure 4:
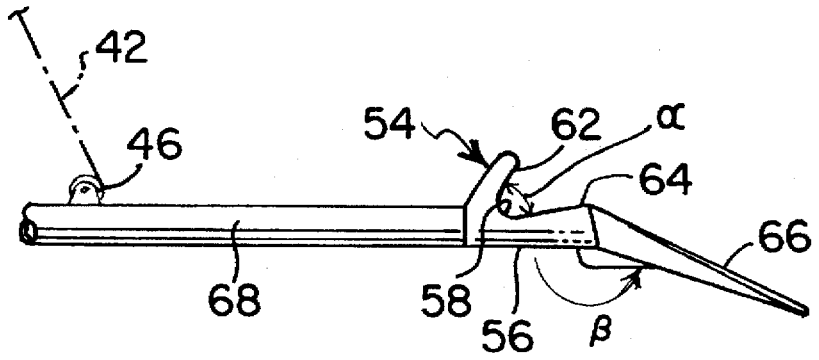
FIG. 4 is a side view of a pick-up means for use in the system.

In the embodiment illustrated in FIG. 4, the members 50 and 52 have been omitted, and claw structure 54 is at the end of outer part 60 of arm 20.

The arm 20 is rotatable between the upper position illustrated in FIG. 1 and a lower position in which the outer part 60 of deployment arm 20 is submerged well below the surface of the water.

The outer part 60 of arm 20 is illustrated in an intermediate position in FIG. 4.

It will be noted that the open seat 58 in the upper position opens upwardly and inwardly toward platform 12. The angle $\alpha$ subtended by the sides 62 and 64 of seat 58 is less than 90° and preferably about 70°.

In the lower position illustrated in FIG. 4 the open seat 58 opens in the outward and upward direction.

In the preferred embodiment the lower side 64 of open claw structures 54 is provided with an elongated guide member 66 which extends at an angle $\beta$ of about 140° to about 160° to downwardly from the lower side of the arm 20. The angle $\beta$ is not critical. The function of guide member 66 is discussed below. Member 66 is preferably from about 2 to about 3 meters in length.

Figure 5:
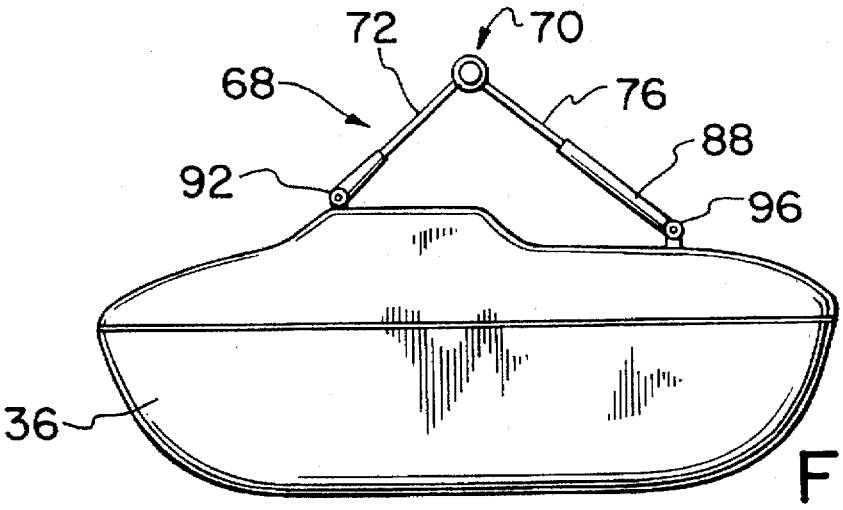
FIG. 5 is a side elevation of a boat for use in the system.
Figure 6:
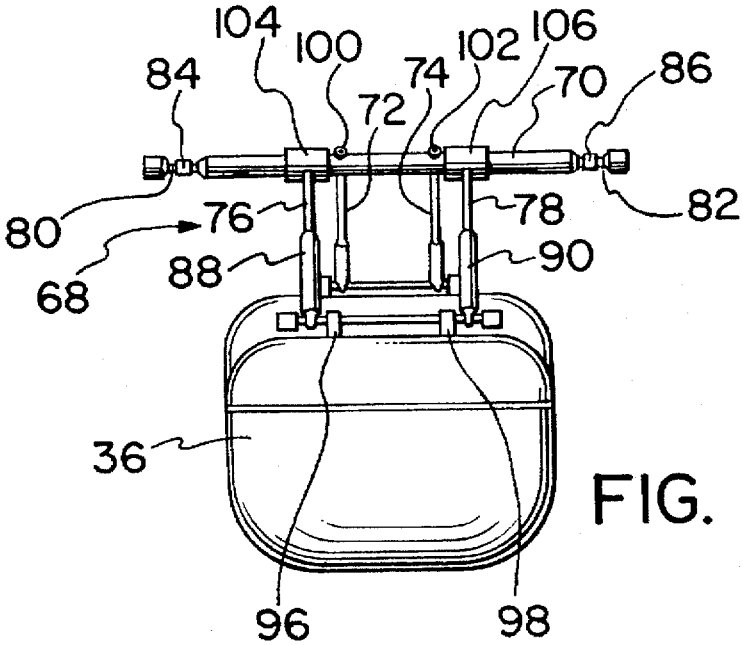
FIG. 6 is a rear end view of a boat for use in the system.
Figure 7:
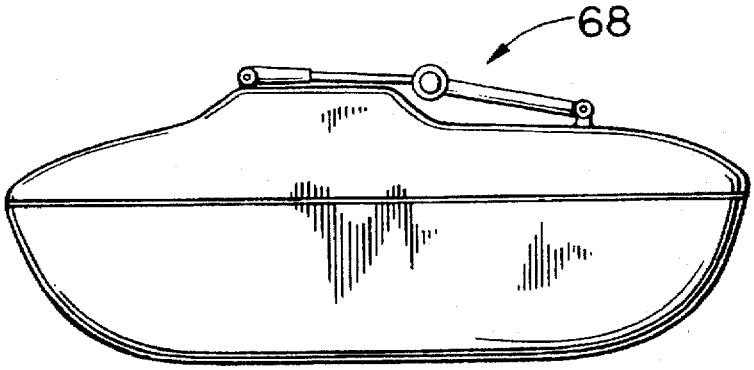
FIG. 7 is a side elevation illustrating a boat for use in the system with a suspension system in a collapsed condition.

Turning to FIGS. 5 to 7, a preferred configuration of suspension means 68 is illustrated on boat 36. Suspension means 68 comprises transverse member 70, preferably tubular, mounted on suspension support members 72 and 74, and 76 and 78.

While the preferred embodiment is illustrated in which the transverse member 70 is supported by forward pair of members 72 and 74 and rearward pair of members 76 and 78, various other configurations of support members might be found suitable.

The transverse member 70 is provided with recesses 80 and 82 to mate with the open claw structures 54 of rotatable arm 20. Recesses 80 and 82 are preferably provided with collars 84 and 86 which are free to rotate on transverse member 70.

Suspension 68 includes shock absorbers 88 and 90 on suspension support members 76 and 78 respectively. Said shock absorbers could alternatively be placed on members 72 and 74 or on both pairs.

Any suitable form of shock absorber, such as hydraulic or coil spring, may be used. In the preferred embodiment suspension means 68 has as forward support members 72 and 74 rotatably anchored on boat 36 at 92 and 94 (the latter not illustrated) and rearward support members 76 and 78 rotatably anchored to boat 36 at 96 and 98 respectively. In this preferred configuration the suspension means 68 is constructed to move between the extended condition illustrated in FIG. 5 and the collapsed condition illustrated in FIG. 7. To enable this movement to take place, the forward suspension support members 72 and 74 are fixed to transverse member 70 at 100 and 102, while rearward suspension support members 76 and 78 are rotatably attached to transverse member 70 by collars 104 and 106.

The operation of the system will now be described. For evacuation purposes, the system will operate essentially as described in U.S. Pat. No. 5,341,761. Accordingly, for present purposes, the operation will be described in terms of the maintenance function at an unmanned platform. In the unmanned platform situation, the platform has heretofore been required to be equipped with survival craft and launch means for the survival craft, for evacuation of the platform should an emergency situation occur while maintenance crews or other personnel, brought in by helicopter, are on the platform.

Utilizing the present system, maintenance personnel and boat 36 will be brought to an unmanned platform by a mothership. On approaching platform 12, remote control means will be activated to lower rotatable arm 20 to a position at which the open claw structures are at an appropriate level to mate with transverse member 70.

A remote control means is not per se a part of the invention but may operate by means of an umbilical cord from the platform or by radio frequency or the like signals.

Once the arm 20 has been lowered to the desired level, the guide members 66 will extend downwardly into the water.

The boat 36, containing personnel required to board the platform, will be unloaded from the mothership and will be manoeuvred to a position in which the stem of boat 36 is in the direction of arm 20 and between arm extensions 50 and 52 and guide members 66. As the boat 36 is then manoeuvred in reverse toward arm 20, the depressions 80 and 82 of transverse member 70 will engage guide members 66. The collars 84 and 86 then rotate along guide members 66 to enable the boat 36 to move up to and into the open claw structures 54.

Up to this point the suspension system 68 will preferably be in the collapsed position of FIG. 7.

As the collars 84 and 86 contact guide members 66, wave action will cause the boat 36 to move up and down relative to guide member 36. During that time, shock absorbers 88 and 90 will permit suspension means 68 to move up and down so that the shock absorbers 88 and 90 will take up the shock of contact between transverse member 70 and guide member 66 to thus substantially maintain contact and minimize the mount of shock actually transmitted to the boat and to personnel within it. This will continue until transverse member 70 is mated with open claw structures 54.

As soon as transverse member 70 mates with open claw structures 54, arm 20 will begin to raise and will move suspension means 68 to the extended position illustrated in FIG. 5. Shock absorbers 88 and 90 will again cushion the initial shock as the arm 20 begins to lift the boat.

Figure 1:
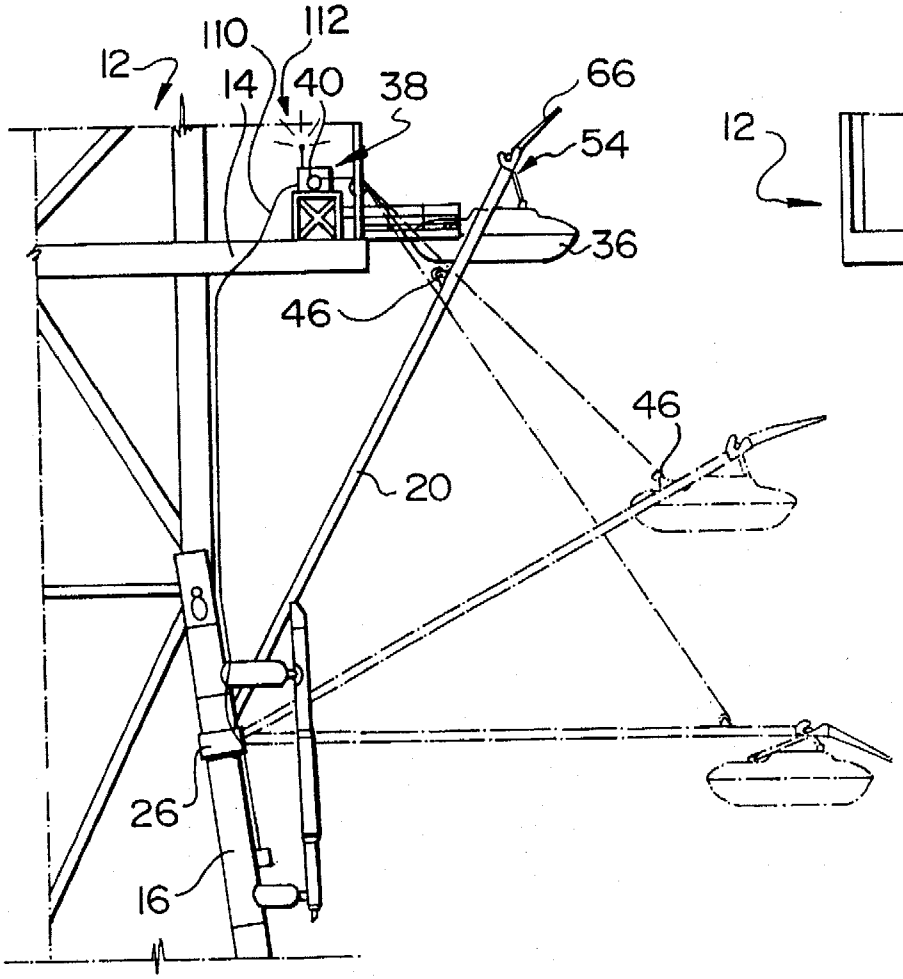
FIG. 1 is a side elevation of the system illustrating a boat in place on a platform.
Figure 3:
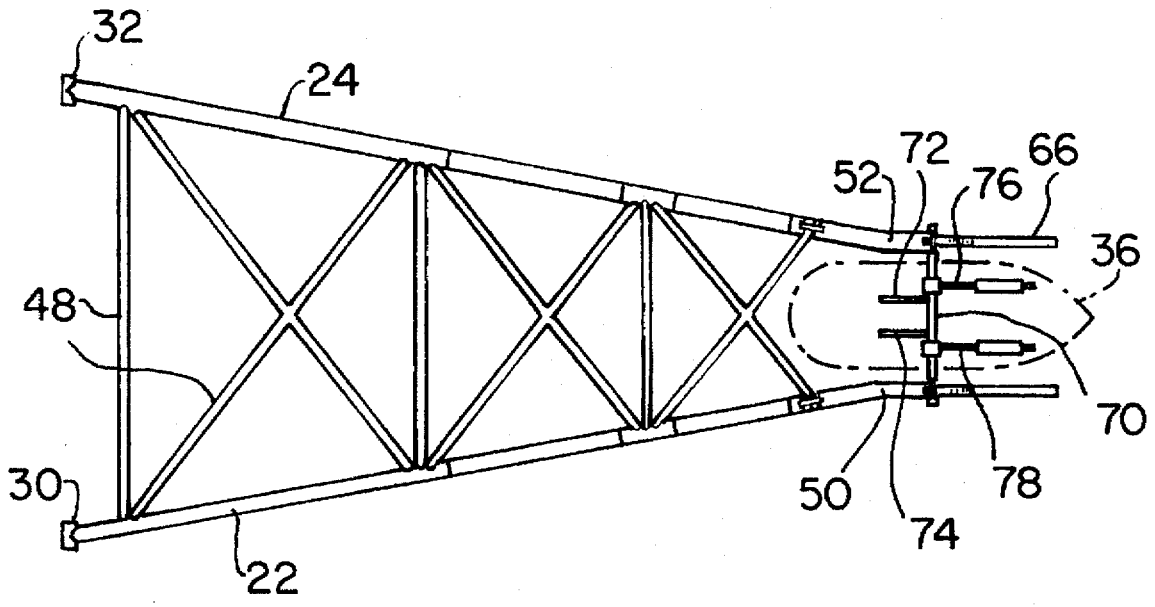
FIG. 3 is a top plan view of a rotating arm with a boat in place.

Personnel will disembark onto the platform when the boat has reached the position shown in FIG. 1.

When maintenance or other work has been completed, personnel will reboard the boat 36 and arm 20 will then be rotated downwardly. Arm 20 will simply be rotated well below the surface of the water so that the open claw structures 54 fall away from transverse member 70 as boat 36 begins to float. Boat 36 is thus deposited at a safe distance from the support members of platform 12 and in a direction away from the platform.

Thus, it is apparent that there has been provided in accordance with the invention an access and evacuation system for an offshore platform that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

I claim as my invention:

1. An access and evacuation system for an offshore platform, said system comprising:

a rotating arm for mounting on the support structure of an offshore platform, said arm selectively moveable between an upper position in which an outer end of said arm is adjacent said platform, and a lower position in which said outer end of said arm is below water and remote from said platform;

pick-up means on said arm adjacent said outer end of said arm for capturing and suspending a boat;

a winch for selectively raising and lowering said arm;

a boat;

suspension means on said boat as a part of said boat for mating with said pick-up means; and shock absorber means on said suspension means for minimizing shock to said boat when said boat is being captured by said pick-up means.

2. The system of claim 1 wherein said pick-up means comprises an open claw structure including upper and lower sides.

3. The system of claim 2 wherein said open claw structure is oriented upwardly and outwardly relative to said arm when said arm is in said lower position.

4. The system of claim 3 wherein said open claw structure includes an elongated guide member on at least one of an upper or a lower side of said structure.

5. The system of claim 4 wherein said open claw, structure includes an elongated guide member on a lower side of said open claw structure.

6. The system of claim 5 wherein said guide member extends at an angle of about 140° to about 160° downwardly from said lower side of said arm.

7. The system of claim 6 wherein said guide member is about 2 m to about 3 m in length.

8. The system of claim 1 wherein said winch is remote controlled.

9.The system of claim 1 wherein said suspension means on said boat comprises at least one suspension support member secured to said boat, a transverse member carried on said at least one suspension support member, and a shock absorber on at least one said suspension support member.

10. The system of claim 9 wherein said transverse member includes a recess toward each end thereof for mating with said pick-up means.

11. A marine access craft having mounted thereon as a part of said craft suspension means for lifting and lowering said craft, said suspension means comprising at least one suspension support member secured to said craft, a transverse member carried on said at least one suspension support member for mating with a pick up means for lifting and lowering said craft, and a shock absorber on at least one said suspension support member for minimizing shock to said craft when said craft is being lifted and lowered.

12. The access craft of claim 11 wherein said suspension means is collapsible between a position in which said shock absorber is retracted and a position in which said shock absorber is extended.

13. The access craft of claim 12 wherein said suspension means comprises at least one forward and at least one rearward suspension support member rotatably secured to said boat.

14. The access craft of claim 13 wherein said suspension means comprises a forward and a rearward pair of suspension support members and wherein at least one said pair includes a shock absorber on each member of said pair.

15. The access craft of claim 14 wherein said rearward pair includes shock absorbers.

16. The access craft of claim 13 wherein each said suspension support which includes a shock absorber is rotatably secured to said transverse member.

17. An access and evacuation system for an offshore platform, said system comprising:

a rotating arm for mounting on the support structure of an offshore platform, said arm selectively moveable between an upper position in which an outer end of said arm is adjacent said platform, and a lower position in which said outer end of said arm is below water and remote from said platform;

pick-up means on said arm adjacent said outer end of said arm for capturing and suspending a boat;

a winch for selectively raising and lowering said arm;

a boat; and suspension means on said boat for mating with said pick-up means, said suspension means comprising at least one suspension support member secured to said boat, a transverse member carried on said at least one suspension support member, and a shock absorber on at least one said suspension support member, and wherein said suspension means is collapsible between a position in which said shock absorber is retracted and a position in which said shock absorber is extended.

18. The system of claim 17 wherein said suspension means comprises at least one forward and at least one rearward suspension support member rotatably secured to said boat.

19. The system of claim 18 wherein said suspension means comprises a forward and a rearward pair of suspension support members and wherein at least one said pair includes shock absorbers.

20. The system of claim 19 wherein said rearward pair includes shock absorbers.

21. The system of claim 18 wherein each said suspension support member includes a shock absorber and is rotatably secured to said transverse member.

22. An access and evacuation system for an offshore platform, said system comprising:

a rotating arm for mounting on the support structure of an offshore platform, said arm selectively moveable between an upper position in which an outer end of said arm is adjacent said platform, and a lower position in which said outer end of said arm is below water and remote from said platform;

pick-up means on said arm adjacent said outer end of said arm for capturing and suspending a boat;

a winch for selectively raising and lowering said arm;

a boat; and suspension means on said boat for mating with said pick-up means, said suspension means comprising at least one suspension support member secured to said boat; a transverse member carried on said at least one suspension support member and having a recess toward each end thereof for mating with said pick-up means, each said recess including therein a freely rotatable beating collar; and a shock absorber on at least one said suspension support member.

23. An access and evacuation system for an offshore platform, said system comprising:

a rotating arm for mounting on the support structure of an offshore platform, said arm selectively moveable between an upper position in which an outer end of said arm is adjacent said platform, and a lower position in which said outer end of said arm is below water and remote from said platform;

pick-up means on said arm adjacent said outer end of said arm for capturing and suspending a boat, said pick-up means comprising an open claw structure having an elongated guide member extending from a lower side thereof;

a winch for selectively raising and lowering said arm;

a boat; and suspension means on said boat for mating with said pick-up means, said suspension means comprising a forward and a rearward pair of suspension support members rotatably mounted on said boat, a transverse member fixedly mounted on said forward pair and rotatably mounted on said rearward pair, and a shock absorber mounted on each of said rearward pair; and wherein said transverse member includes a recess spaced from each end thereof for mating with said pick-up means.

* * * * *

UNITED STATES PATENT AND TRADEMARK OFFICE

CERTIFICATE OF CORRECTION

PATENT NO. : 5,706,755

DATED : January 13, 1998

INVENTOR(S) : O'Brien

It is certified that error appears in the above-identified patent and that said Letters Patent is hereby corrected as shown below:

Please correct in claim 22, line 20, the word "beating" to --bearing--.

Signed and Sealed this

Fifth Day of May, 1998

Bruce Lehman

BRUCE LEHMAN

*Commissioner of Patents and Trademarks*

*Attest:*

*Attesting Officer*